US008528276B2

(12) United States Patent
Bramble et al.

(10) Patent No.: US 8,528,276 B2
(45) **Date of Patent: *Sep. 10, 2013**

(54) APPARATUS AND METHOD FOR DIVERTING WATER AT BASEMENT JOINTS

(71) Applicant: Dry Basement, Inc., Kansas City, MO (US)

(72) Inventors: Curtis Bramble, Kansas City, MO (US); Otto W. Fleck, Kansas City, MO (US); Lowell Hickman, Riverside, MO (US)

(73) Assignee: Dry Basement, Inc., Kansas City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/662,957

(22) Filed: Oct. 29, 2012

(65) Prior Publication Data

US 2013/0047534 A1 Feb. 28, 2013

Related U.S. Application Data

(63) Continuation of application No. 12/980,601, filed on Dec. 29, 2010, now Pat. No. 8,297,005.

(51) Int. Cl.

| | |
|---|---|
| ***E02D 19/18*** | (2006.01) |
| ***E02D 19/00*** | (2006.01) |
| ***E04F 17/00*** | (2006.01) |
| ***E04B 1/70*** | (2006.01) |

(52) U.S. Cl.
USPC ..... 52/169.5; 52/302.3

(58) Field of Classification Search
USPC ..... 52/58, 169.5, 302.3, 302.6; 405/118, 405/229
See application file for complete search history.

(56) References Cited

U.S. PATENT DOCUMENTS

| | | | | | |
|---|---|---|---|---|---|
| 3,850,193 | A | * | 11/1974 | Guzzo | 137/362 |
| 4,185,429 | A | * | 1/1980 | Mendola | 52/274 |
| 4,245,443 | A | * | 1/1981 | Beechen | 52/169.5 |
| 4,381,630 | A | * | 5/1983 | Koester | 52/169.5 |
| 4,590,722 | A | * | 5/1986 | Bevelacqua | 52/302.3 |
| 4,745,716 | A | * | 5/1988 | Kuypers | 52/169.5 |
| 4,773,195 | A | * | 9/1988 | Waller | 52/302.3 |
| 4,869,032 | A | * | 9/1989 | Geske | 52/169.5 |
| 4,930,272 | A | * | 6/1990 | Bevilacqua | 52/302.3 |
| 4,943,185 | A | * | 7/1990 | McGuckin et al. | 405/45 |
| 5,044,821 | A | * | 9/1991 | Johnsen | 405/50 |
| 5,184,437 | A | * | 2/1993 | Woong et al. | 52/169.5 |
| 5,399,050 | A | * | 3/1995 | Jacobus | 405/229 |
| 5,495,696 | A | * | 3/1996 | Repka | 52/169.5 |

(Continued)

FOREIGN PATENT DOCUMENTS

| | | | | |
|---|---|---|---|---|
| GB | 2388852 | A | * | 11/2003 |
| GB | 2411912 | A | * | 9/2005 |

*Primary Examiner* — Basil Katcheves
*Assistant Examiner* — Rodney Mintz
(74) *Attorney, Agent, or Firm* — Hovey Williams LLP

(57) ABSTRACT

A water diverting system for diverting water from a building's foundation, where the foundation has a basement footing having an interior face oriented towards an interior of the foundation, a basement wall having an interior face oriented towards the interior of the foundation, and a basement floor slab. The system includes a channel for collecting water and configured to be installed adjacent the basement footing. The channel is overlaid with a corrugated track for directing water to the channel. A vertical water guide extends perpendicularly from the track and is positioned adjacent the interior face of the basement wall. The guide includes a plurality of spaced projections for directing water trickling down along the wall to the channel.

14 Claims, 5 Drawing Sheets

(56) References Cited

U.S. PATENT DOCUMENTS

| | | | | |
|---|---|---|---|---|
| 5,630,299 | A * | 5/1997 | Jackman et al. | 52/169.5 |
| 5,694,723 | A * | 12/1997 | Parker | 52/169.5 |
| 5,765,323 | A * | 6/1998 | Bevilacqua | 52/169.5 |
| 5,771,643 | A * | 6/1998 | Parker | 52/169.5 |
| 5,794,388 | A * | 8/1998 | Jackman | 52/169.5 |
| 6,105,323 | A * | 8/2000 | Paulle | 52/302.1 |
| 6,477,811 | B1 * | 11/2002 | Choi | 52/169.5 |
| 6,550,190 | B2 * | 4/2003 | Ruiz et al. | 52/169.5 |
| 6,575,666 | B1 * | 6/2003 | Janesky | 405/270 |
| 6,598,360 | B1 * | 7/2003 | Pratt | 52/169.5 |
| 6,672,016 | B2 * | 1/2004 | Janesky | 52/169.5 |
| 6,904,723 | B1 * | 6/2005 | Moore et al. | 52/169.5 |
| 6,926,469 | B2 * | 8/2005 | Janesky | 405/270 |
| 7,621,079 | B2 * | 11/2009 | Takagi et al. | 52/169.5 |
| 7,788,877 | B2 * | 9/2010 | Andras | 52/741.3 |
| 7,810,291 | B2 * | 10/2010 | McPherson | 52/302.3 |
| 7,856,767 | B2 * | 12/2010 | Janesky | 52/169.14 |
| 7,918,055 | B2 * | 4/2011 | Cotten | 52/169.5 |
| 7,954,280 | B2 * | 6/2011 | Andras | 52/169.5 |
| 8,109,046 | B2 * | 2/2012 | Nordhoff et al. | 52/169.5 |
| 8,117,797 | B2 * | 2/2012 | Andras | 52/741.11 |
| 8,186,127 | B1 * | 5/2012 | Pratt | 52/741.11 |
| 8,297,005 | B1 * | 10/2012 | Bramble et al. | 52/169.5 |
| 8,307,587 | B2 * | 11/2012 | Nordhoff et al. | 52/169.5 |
| 8,312,682 | B2 * | 11/2012 | Trotter | 52/302.6 |
| 8,322,944 | B2 * | 12/2012 | Hodgekins et al. | 404/2 |
| 8,397,453 | B2 * | 3/2013 | Shaw | 52/232 |
| 2002/0139068 | A1 * | 10/2002 | Janesky | 52/169.5 |
| 2003/0156905 | A1 * | 8/2003 | Hubert | 405/229 |
| 2003/0233808 | A1 * | 12/2003 | Zuppan | 52/783.1 |
| 2005/0198916 | A1 * | 9/2005 | Janesky | 52/169.5 |
| 2005/0204653 | A1 * | 9/2005 | Matthews | 52/169.5 |
| 2005/0210772 | A1 * | 9/2005 | Janesky | 52/168 |
| 2006/0112653 | A1 * | 6/2006 | Hogenson | 52/169.5 |
| 2006/0156641 | A1 * | 7/2006 | Takagi et al. | 52/62 |
| 2007/0044396 | A1 * | 3/2007 | Janesky | 52/169.5 |
| 2007/0169425 | A2 * | 7/2007 | Takagi et al. | 52/62 |
| 2009/0183445 | A1 * | 7/2009 | McPherson | 52/169.5 |
| 2010/0313507 | A1 * | 12/2010 | Castro et al. | 52/309.4 |
| 2011/0041426 | A1 * | 2/2011 | Trotter | 52/169.5 |
| 2012/0099927 | A1 * | 4/2012 | Dos Santos | 405/118 |
| 2012/0131863 | A1 * | 5/2012 | Nordhoff et al. | 52/169.5 |
| 2012/0180818 | A1 * | 7/2012 | Janesky | 134/22.11 |
| 2013/0036691 | A1 * | 2/2013 | Janesky | 52/302.1 |

* cited by examiner

APPARATUS AND METHOD FOR DIVERTING WATER AT BASEMENT JOINTS

RELATED APPLICATION

This is a continuation application, and claims priority benefit with respect to all common subject matter, of U.S. patent application Ser. No. 12/980,601, filed Dec. 29, 2010, now U.S. Pat. No. 8,297,005, issued Oct. 30, 2012, and entitled "APPARATUS AND METHOD FOR DIVERTING WATER AT BASEMENT JOINTS." The identified earlier-filed patent is hereby incorporated by reference in its entirety into the present application.

BACKGROUND

1. Field

The present inventions relates to systems, apparatuses, and methods for collecting and diverting water from perimeter basement joints where water commonly collects.

2. Related Art

Water entering a building's foundation or basement is a common but potentially very damaging and expensive problem. Points of entry of the water occur at the intersection or joints of the basement footing 10, basement wall 12, and basement floor slab 14. Referring to FIG. 1, the footing 10 is concrete laid in the soil. Thus, the footing 10 defines a perimeter of the building and presents an interior of the foundation 16 that retains soil. The basement wall 12 is positioned atop the footing 10 so as to leave an interiorly exposed interior section 18 of the footing 10. The basement floor slab 14 is then poured atop the interiorly exposed section 18 of the footing 10 and the interior foundation soil.

As water tables rise, the soil surrounding the foundation, including the soil in the interior of the foundation 16 and underneath the footing 10, becomes saturated with water. Due to hydrostatic pressure resulting from the increased volume of soil bearing against the foundation, the soil pushes against the footing 10 on all sides, against an exterior face 20 of the basement wall 12, and underneath the basement floor slab 14. Water then begins to seep in at any joints in the foundation. Again referring to FIG. 1, these joints exist where the footing 10, the basement floor slab 14, and the basement wall 12 intersect. In particular, water from water-saturated soil in the interior of the foundation 16 is leached to an underside of the floor slab 14 due to capillary action, where the water then seeps along the top of the footing 10 and to a top of the basement floor 14. Water also enters the foundation at the exterior face 20 of the basement wall 12, along the top of the footing 10, and up to the basement wall 12. Finally, water enters along an interior face 22 of the basement wall 12 and at the floor 14.

Water diverting or drainage systems have been developed to combat at least some of the sources of water in a basement. In a first system, a perforated drain pipe (commonly referred to as a "drain tile") is installed in the soil proximate to the basement footing and approximately 8-12 inches deep (relative to the top of the footing). Water enters the drain tile horizontally. Because water is naturally intermixed with sediment, and further due to the size of the perforations, the drain tile becomes clogged with soil and other particulates over time. An additional problem with an installed drain tile is that it tends to move away from the footing over time. Thus, when access to the drain tile is required for replacement or mending, the user does not necessarily know where to dig to locate the drain tile. Moreover, the user must dig fairly deeply to access the drain tile at the 8-12 inches depth. Displacement of the soil at this depth is undesirable, as it creates pockets or holes that potentially undermine the integrity of the footing.

In a second system, a pipe having intermittently spaced holes along an interior-facing side of the pipe is installed above the basement footing and under the basement floor slab. Thus, the pipe is not installed directly in the soil, as in the first system. Although the pipe receives water flowing down the interior face of the basement wall and along a top of the footing and under the basement wall, the pipe is insufficient for receiving water leaching upwards from the interior of the foundation. Because soil located in the interior of the foundation is especially prone to retaining water, it is desirable to install a water diverting system that pulls water from the soil in the interior of the foundation and away from the foundation.

Accordingly, there is a need for a water diverting system that is operable to divert water from the three common areas of water collection and that can be installed with minimal interruption to the surrounding soil.

SUMMARY

Embodiments of the present invention solve the above-mentioned problems and provide a distinct advance in the art of water diverting systems. More particularly, embodiments of the present invention provide a system for diverting water from a building's foundation, where the foundation comprises a basement footing having an interior face oriented towards an interior of the foundation, a basement wall having an interior face oriented towards the interior of the foundation, and a basement floor slab.

The present invention comprises a channel for collecting water, a generally horizontally extending, corrugated track, and a generally vertically extending guide. The channel has a body presenting a bottom end and a top end, said bottom end defined by a floor having first and second sides. The body further includes a first wall extending generally upwardly from the first side of the floor, and a second wall extending generally upwardly from the second side of the floor. The body presents an opening at the top end for receipt of water into the body. The body is configured for installation below the basement floor slab and generally adjacent to the interior face of the footing.

The corrugated track has a first side and a second side and includes a plurality of downwardly extending ridges interposed with a plurality of upwardly extending furrows, wherein the ridges and furrows extend horizontally between the first and second sides of the track. The track is configured for installation below the basement floor slab and at least partially overlaying the opening of the body of the channel, such that the first side of the track is proximate the interior face of the basement wall, and the second side of the track faces the interior of the foundation. When installed, each ridge is spaced a vertical distance above the top end of the body of the channel.

The water guide extends vertically from and is generally perpendicular to the track. The guide is configured for installation proximate to the interior face of the basement wall for diverting water entering along the interior face of the basement wall to the channel. The guide includes a wall generally perpendicular to the track and a plurality of intermittently spaced projections extending towards the interior face of the basement wall.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
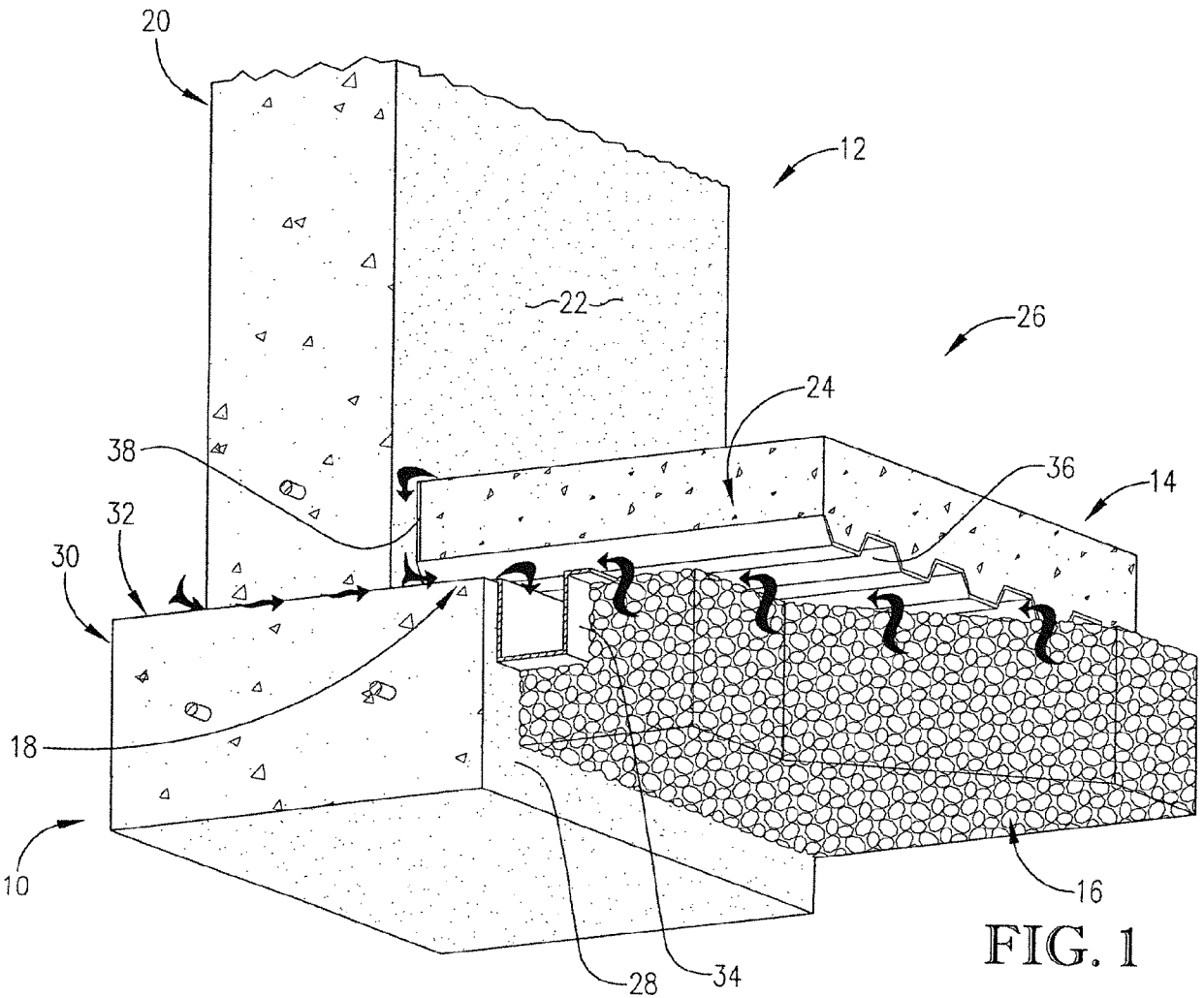
FIG. 1 is a perspective view of a building foundation and illustrating an embodiment of the present invention installed at the building foundation and further illustrating a direction of water entry into the building's foundation via a plurality of directional arrows.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

An embodiment of the water diverting system 24 of the present invention is illustrated in FIGS. 1-7. The system 24 diverts water from a building's foundation 26 where water enters a basement at points of weakness, which often occur at basement joints. The building foundation 26 generally comprises a basement footing 10 providing the footprint for the building. The basement footing 10 is commonly installed directly above soil or rock. The basement footing 10 establishes a perimeter for the building, such that the basement footing 10 has an interior face 28 oriented towards an interior of the foundation 16, an exterior face 30 oriented towards an exterior or outside of the building, and a top face 32. The foundation 26 further includes a basement wall 12 extending vertically from the footing 10. The basement wall 12 is installed intermittent the top face 32 of the footing 10, such that the footing 10 presents an interiorly exposed section 18 having a width extending from an interior face 22 of the basement wall 12 and to the interior of the foundation 16. The foundation 26 also includes a horizontal basement floor slab 14 installed within the interior of the foundation 16 and over the interiorly exposed section 18 of the footing 10.

Embodiments of the present invention generally comprise an elongated channel 34 positioned proximate the interior face 28 of the footing 10 for collecting water; a generally horizontally extending, corrugated track 36 positioned at least partially on the interiorly exposed section 18 of the footing 10 and extending at least partially over the channel 34; and a generally vertically extending guide 38 having a plurality of spaced projections 40, said guide 38 positioned proximate to the interior face 22 of the basement wall 12 and for diverting water entering along the interior face 22 of the basement wall 12 to the channel 34. The embodiment illustrated in the Figures shows a fragment of the invention relative to the foundation 26; however, it should be appreciated that the channel 34, track 36, and guide 38 components of the present invention extend around substantially all of the interior of the foundation 16. The channel 34, track 36, and guide 38 components may be manufactured in segments for ease of installation.

Figure 3:
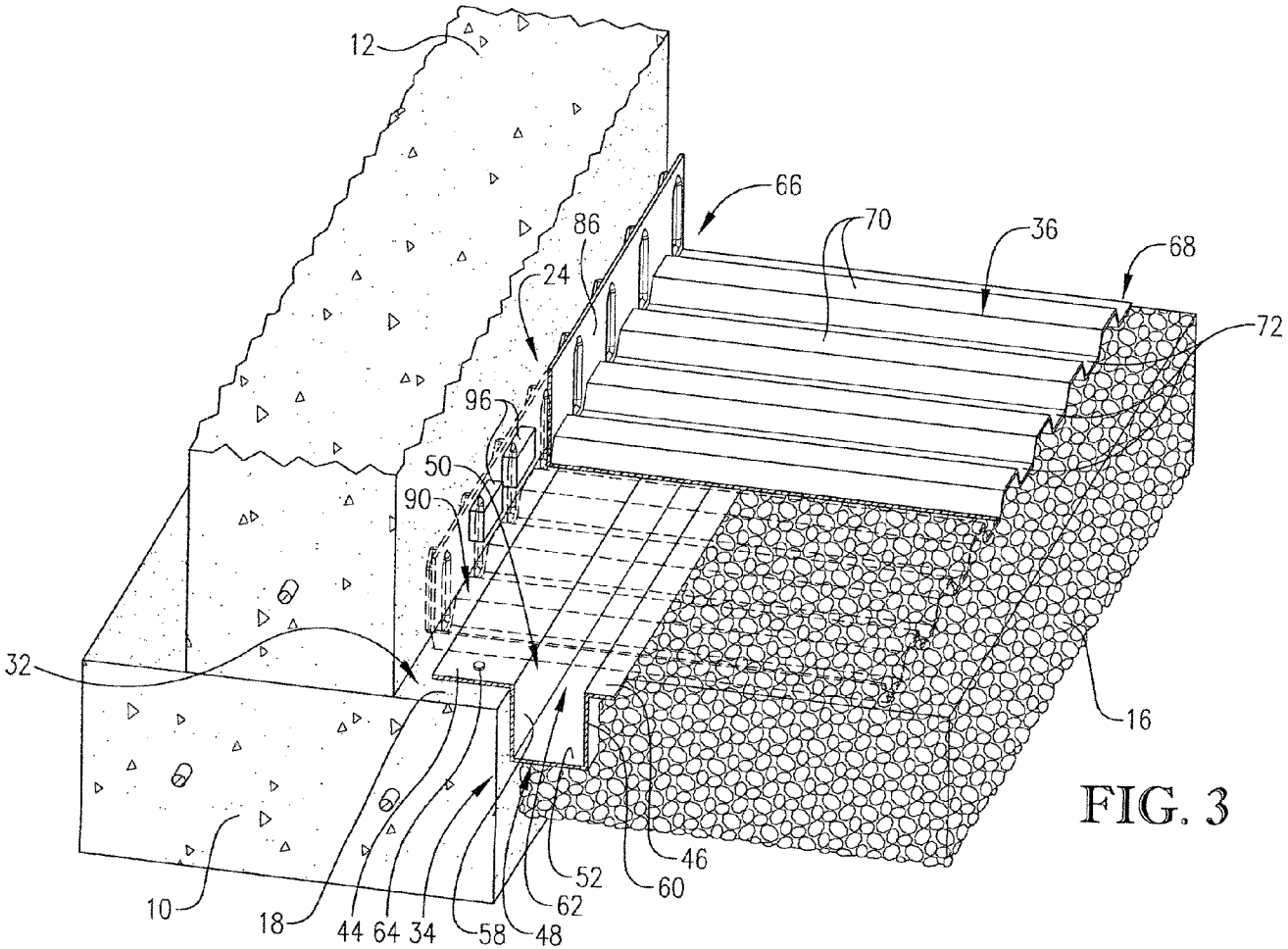
FIG. 3 is a perspective view illustrating the present invention installed at the building foundation and specifically illustrating a fragment of the channel and track in phantom.
Figure 4:
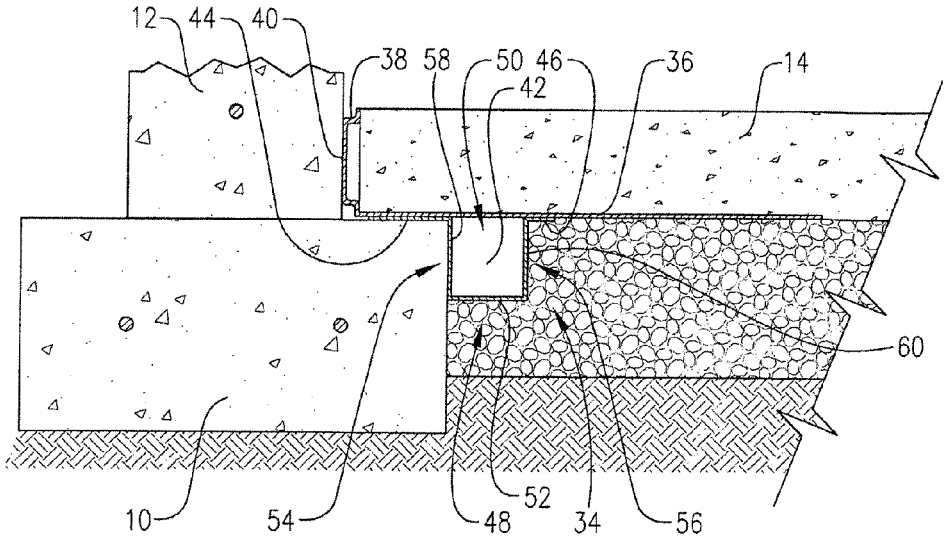
FIG. 4 is a vertical cross-sectional view taken along a vertical line intersecting a furrow of the track and illustrating the present invention installed at the building foundation and particularly showing the intersection of the furrow of the track with the channel.
Figure 5:
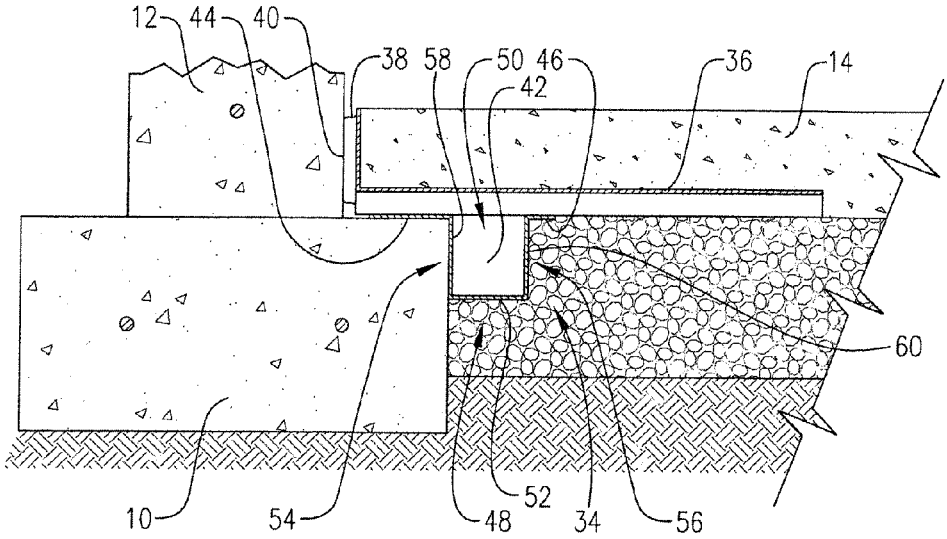
FIG. 5 is a vertical cross-sectional view taken along a vertical line intersecting a ridge of the track and illustrating the present invention installed at the building foundation and particularly showing the ridge vertically spaced from the channel so as to present an opening.

Referring to FIGS. 3 and 4, the channel 34 is generally U-shaped and comprises a body 42, a first flange 44 configured for securing to the interiorly exposed section 18 of the footing 10, and a second flange 46 extending towards the interior of the foundation 16. The body 42 presents a bottom end 48 and a top end 50. The bottom end 48 is defined by a generally horizontally extending floor 52 having first and second sides 54,56. When the channel 34 is installed, the first side 54 is proximate the interior face 28 of the footing 10, as described in more detail below. A first wall 58 extends upwards from the first side 54 of the body floor 52, and a second wall 60 extends upwardly from the second side 56 of the floor 52. The first and second walls 58,60 are generally parallel and spaced a distance of approximately 2-6 inches and more preferably approximately 4 inches.

As best illustrated in FIG. 3, the top end 50 of the body 42 preferably presents an opening 62 or is otherwise at least partially open for receipt of water into the channel 34. As described below, the track 36 is positioned over the opening 62 in the top end 50 of the body 42 to guide and divert water into the channel 34. In the Figures, the opening 62 encompasses the entire top end 50 of the body 42; however, in alternative embodiments of the present invention, the opening 62 may be substantially less than the entire top end 50 of the body 42 but still of sufficient size to allow water to drain into the body 42. For example, the top end of the body 42 could be at least partially covered to present a smaller opening. As an even further alternative, a perforated, slotted, or mesh screen (not shown) could be placed over or integral with the top end 50.

Referring to FIGS. 3 and 4, the first flange 44 of the channel 34 extends generally perpendicularly from the first wall 58 and top end 50 of the body 42. The first flange 44 is approximately 3 inches in width, approximately 90 inches in length (or approximately a length of the track 36 and guide 38), and approximately 0.06 inch thick. The first flange 44 is configured for securing or coupling with the top face 32 of the footing 10 at the interiorly exposed section 18. Thus, the first flange's width is preferably less than a width of the exposed section 18 of the footing 10 and is more preferably at least 1 inch less than the width of the exposed section 18 of the footing 10. A ratio of the width of the interiorly exposed section 18 of the footing 10 to the width of the first flange 44 is preferably approximately less than 2:1, more preferably approximately less than 1.5:1, and most preferably approximately less than 1.2:1. In some instances, the width of the interiorly exposed section 18 of the footing 10 may be only slightly greater (by approximately 0.25-2 inches) than the width of the first flange 44.

The first flange 44 is secured to the footing 10 via a plurality of spaced screws, bolts, or other fasteners 64. The fasteners 64 are preferably formed of a material that will not degrade or rust during prolonged use. A suitable fastener 64 is formed of nylon and may include a plastic drop-in anchor. Other methods and mechanisms for securely coupling the first flange 44 with the exposed section 18 of the footing 10 are contemplated.

The second flange 46 of the channel 34 extends generally perpendicularly from the second wall 60 and top end 50 of the body 42 and towards the interior of the foundation 16. The second flange 46 is approximately 0.75 inch in width, approximately 90 inches in length (or approximately a length of the track 36 and guide 38), and approximately 0.06 inch in thickness. The second flange 46 assists in supporting the track 36, which is positioned over the first flange 44 and the top end 50 of the body 42, as noted above, and which, in embodiments of the present invention, is further positioned over and extends beyond the second flange 46. If desired, the track 36 may also be secured to the second flange 46 via screws, nails, or other suitable fastener (not shown).

The channel 34 is preferably formed of polypropylene, ABS, or other suitable material. As noted above, the channel 34 may be manufactured in segments for ease of installation. The segments would then be positioned adjacent each other along the perimeter of the foundation's footing 10. The length of each segment may be approximately 70-110 inches and more preferably approximately 90 inches, although it should be appreciated that shorter or longer segments may be manufactured, and the segments may be cut on-site for ease of installation.

Figure 6:
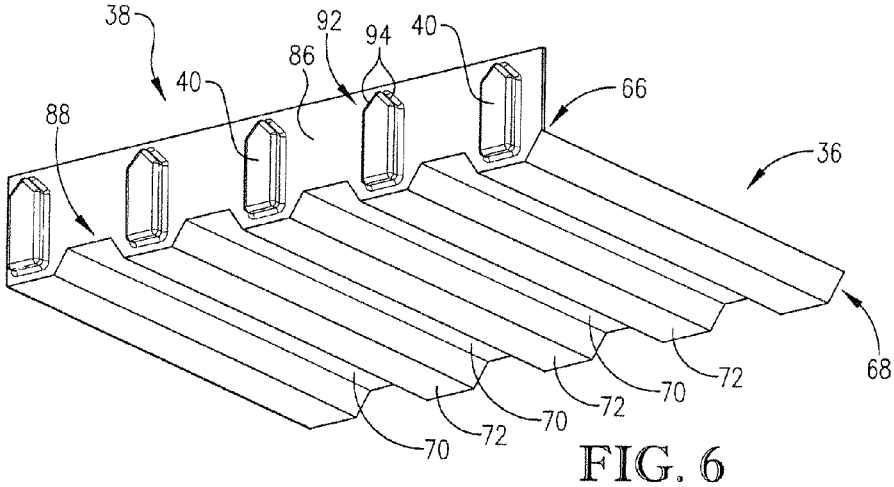
FIG. 6 is a first perspective view of the track and a water guide of the present invention and showing the projections intermittently spaced thereon.
Figure 7:
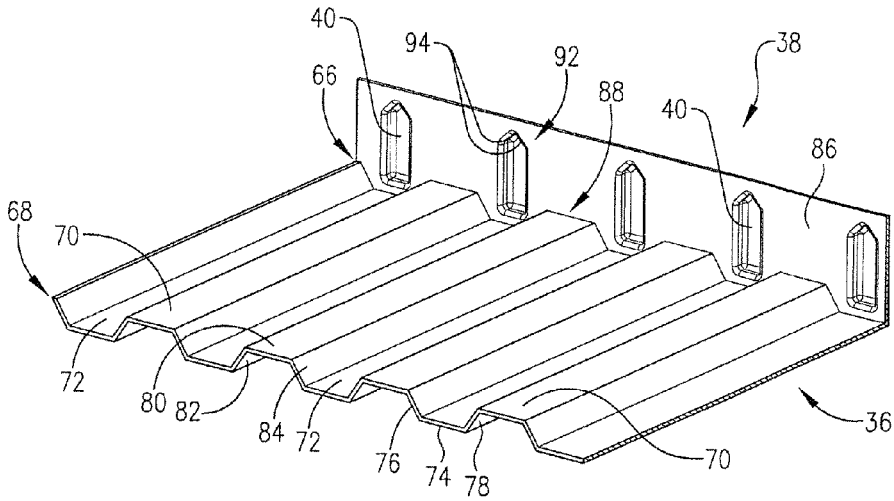
FIG. 7 is a second perspective view of the track and the water guide of the present invention and showing the projections intermittently spaced thereon.

As illustrated in FIGS. 3 and 6-7 and noted above, the track 36 is corrugated and thus presents a first side 66 and a second side 68 and includes a plurality of interposed upwardly extending or facing ridges 70 and downwardly extending or facing furrows 72 extending horizontally between the first and second sides 66,68. As discussed in more detail below, the track 36 is configured for installation below the basement floor slab 14 and at least partially overlaying the opening 62 of the body 42 of the channel 34, such that the track 36 extends horizontally over the channel 34. As illustrated, the track 36 completely overlays the opening 62 of the body 42. The first side 66 of the track 36 is positioned proximate the interior face 22 of the basement wall 12, and the second side 68 of the track 36 is positioned proximate to and extends toward the interior of the foundation 16. When installed, each ridge 70 is spaced a vertical distance above the top end 50 of the body 42 of the channel 34 so as to present an opening between the top of the channel 34 and bottom of the ridge 70, as illustrated in FIGS. 1-3 and 5.

Referring to FIGS. 6 and 7, the downward facing ridges 70 and upward facing furrows 72 are interposed between each other, such that each downward facing ridge 70 is between two upward facing furrows 72 (except for a ridge located at an end of the track), and similarly, each upward facing furrow 72 is between two downward facing ridges 70 (except for a furrow located at an end of the track). The interposed downward facing ridges 70 and upward facing furrows 72 present the generally corrugated or fluted track 36.

The interposed ridges and furrows 70,72 can present various cross-sectional shapes, such as trapezoidal (illustrated in drawings), rectangular, circular, elliptical, or ovoid. As discussed in more detail below, the ridges 70 of the track 36 serve to direct water to the channel 34, whereas the furrows 72 of the track 36 serve to provide structural integrity to the track 36. Thus, any cross-sectional shape may be used that accomplishes the respective directing water and structural integrity. In a preferred embodiment illustrated in the drawings, the track 36 is approximately 0.5-2 inches high and more preferably approximately 1 inch high. Moreover, the track is approximately 70-111 inches in length and more preferably 90 inches in length so as to be approximately the same length as the channel. The track is approximately 8-12 inches in width (i.e., the distance spanning the length of each ridge 70 and furrow 72) and more preferably approximately 10 inches in width.

Referring to FIG. 7, if each furrow 72 is defined to include a bottom 74, a left side 76, and a right side 78, then a width of the furrow 72 is approximately 2-3 inches and more preferably approximately 2.5 inches, with the bottom 74 being approximately 2 inches in width and each side 76,78 accounting for approximately 0.25 inch of width (when viewed in cross section). Similarly, if each ridge 70 is defined to include a top 80, a left side 82, and a right side 84, then a width of each ridge 70 is approximately 2-3 inches and more preferably approximately 2.5 inches, with the top 80 being approximately 2 inches in width and each side 82,84 accounting for approximately 0.25 inch of width (again when viewed in cross section). It is to be appreciated that one of the left and right sides 76,78 of each furrow 72 is the other of the respective left and right sides 82,84 of each ridge 70, except for the end ridge or furrow.

The widths (when viewed in cross section) of the ridges 70 and furrows 72 may be smaller or larger than the widths provided above, and in some instances, the width of the ridges 70 may be larger than the width of the furrows 72 and vice-versa, so as to provide a ratio of ridge width to furrow width that is greater than 1:1. For example, in alternative embodiments of the invention, the width of each ridge 70 may be 1.5 to even 5 times greater than the width of each furrow 72. Such a construction may be desired to allow for directing a greater amount of water to the channel 34. However, as discussed in more detail below, the approximate 1:1 width size of the respective ridges 70 and furrows 72 provides a balance of sufficiently high exposed ridge area to divert water and structural integrity provided by the furrow. Additionally, and as discussed below, the furrow width complements the spacing of the projections 40 in the water guide 38.

Referring now to FIGS. 3 and 6-7, the guide 38 for directing water moving downwardly along the basement wall 12 and to the channel 34 is illustrated. The guide 38 includes a wall 86 positioned generally perpendicular to the track 36. The plurality of intermittently spaced projections 40 are intermittently spaced along the wall and extend towards the interior face 22 of the basement wall 12 in the installed position as best illustrated in FIG. 3. The wall 86 is generally flat, except for the spaced projections 40. A bottom 88 of the wall 86 is complementally shaped to match the shape of the interposed ridges 70 and furrows 72 of the track 36. Thus, the bottom 88 of the wall complementally matches the cross-sectional shape of the ridges 70 and furrows 72, such that the bottom 88 of the wall 86 presents a plurality of openings 90 in fluid communication with the ridges 70. In preferred embodiments of the present invention, the wall 86, projections 40, and track 36 are integral.

Each projection 40 is spaced to be generally aligned with a furrow 72. For example and as best illustrated in FIGS. 6-7, each projection is aligned with and falls within the cross-sectional width of the furrow 72, and specifically, across the cross-sectional width of the bottom 74 of the furrow 72. Thus, when water trickles down along the interior face 22 of the basement wall 12, it is diverted by the projection 40 and to the wall area aligned with the ridges 70 on either side of the furrow 72.

Each projection 40 includes an upper end 92 that is preferably not flat or generally horizontal, such that water contacting the projection's upper end 92 as it flows down the basement wall 12 will be diverted away from the projection 40 and to the ridges 70 on opposing sides of the projection 40. If the projection's upper end 92 is flat so as to present a generally horizontal ledge, then water will tend to accumulate on the ledge and not flow downwards to the ridges 70 and ultimately, the channel 34.

In embodiments of the present invention, the upper end 92 of the projection 40 has first and second angled upper sides 94 so as to present an inverted V-shape. Alternatively, the upper end 92 of the projection 40 can be generally arcuate, so as to present a downward-facing, half-circular shape (not shown). Other shapes for the upper end 92 of the projection 40 may be employed to the extent the shape directs the water away from the furrow 72 and, preferably, towards the opposing ridges 70.

Each projection 40 is preferably closed on all sides so that water will not flow over the non-flat upper end 92 but then be drawn back under the upper end. However, it is to be understood that a projection that is at least partially closed on all sides can satisfy the diversion of water to the ridges 70. Alternatively, the angled sides 94 of the upper end 92 of the projection 40 may be of a length to direct the water towards the ridges 70 without requiring the projection 40 to be enclosed on all sides. In such a case, a sufficient length for the angled sides 94 is dependent on the width of the furrow 72.

In the described embodiment with the furrow's bottom 74 being approximately 2 inches in width, the projection's width is approximately 1.5-2.5 inches and more preferably approximately 2.2 inches. The projection's depth is approximately 0.25-1 inch and more preferably 0.5 inch and the height is approximately 1.5-3.5 inches and more preferably approximately 2.75 inches.

The guide 38 is approximately 4 inches high, although shorter or taller guides may be employed. A length of the guide is preferably sized to accommodate the length of the track 36 for ease of installation, although guides 38 having lengths shorter or longer than the length of the track 36 may be employed. The projection's upper end 92 is preferably spaced approximately 0.75 inch from a top of the track 36.

In addition to diverting water at basement joints away from the building's foundation, embodiments of the present invention also assist in preventing radon leakage to the building's basement. Referring to FIG. 3, embodiments of the present invention employ a water-permeable barrier 96 positioned between the wall 86 of the water guide 38 and the interior face 22 of the basement wall 12. The barrier 96 is preferably formed of a high-density foam that allows water to soak into and through the foam but prevents radon, which naturally rises from the earth, to escape the barrier 96 and leak into the basement. Because radon is heavier than air, the barrier 96 sufficiently minimizes or completely prevents radon leakage to the basement at the floor-wall joint.

The barrier 96 may be cut into segments that are positioned between the guide's wall 86 and the interior face 22 of the basement wall 12. Preferably, the barrier 96 is located at a height approximately ⅔ a height of the projection 40, such that water being diverted along the upper end 92 of the projection 40 first encounters barriers 96 on either side. The water will then be transmitted through the barriers 96, to the ridges 70, and ultimately, to the channel 34. Alternatively, the barrier 96 may be positioned above the upper end 92 of the projections 40. The barrier 96 is approximately 1-3 inches in height and approximately 0.25-1.5 inches in depth. The width of the barrier 96 corresponds approximately to a width between adjacent projections 40, such that the width of each segment of barrier 96 is approximately 3-3.75 inches. Alternatively, if the barrier 96 is positioned above the projections 40, the barrier 96 could be of any sufficient length for installation, such as approximately 90 inches. The barrier 96 can be easily removed and reinstalled for accessing and fixing of any cracks in the basement wall 12.

Figure 2:
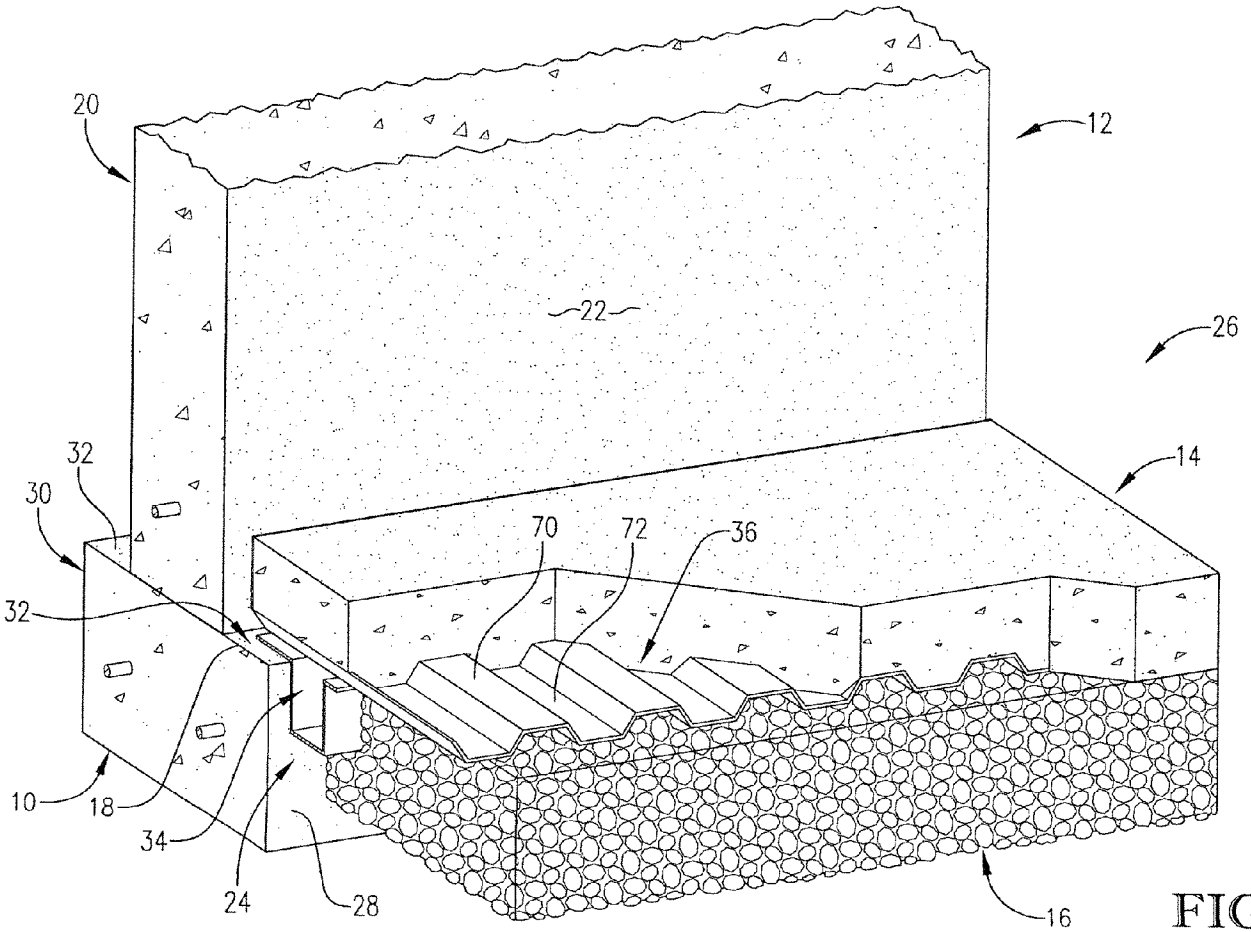
FIG. 2 is a perspective view illustrating the present invention installed at the building foundation and specifically illustrating a channel and track of the present invention.

Installation and operation of the water diverting system 24 of the present invention will now be described. Referring to FIGS. 1-3, the installer of the system 24 will excavate a trench adjacent the basement footing 10 approximately 6-8 inches in width and approximately 4-6 inches in depth. Thus, the depth of the excavation is approximately 25-50% less than prior art systems that employ a drain tile. Additionally, because the trench is located directly adjacent the footing 10, the amount of soil removed at locations where pockets of air arise due to disturbing the soil is minimized. After the trench is dug, it may be backfilled with gravel or rock to assist in drainage and proper placement of the channel 34, although such is not required.

The channel 34 is then installed by positioning the first flange 44 of the channel 34 directly atop and adjacent the interiorly exposed section 18 of the footing 10. The first flange 44 is then secured to the footing 10 using screws, bolts, or other fasteners 64, as described above. Once installed, the first wall 58 of the body 42 faces the interior face 28 of the footing 10, is preferably adjacent to the interior face 28 of the footing 10, and, in some instances, is in direct contact with the interior face 28 of the footing 10, although the latter is not required. In its installed position, the body 42 of the channel 34 is below the basement floor slab 14 and generally adjacent to the interior face 28 of the footing 10, such that top end 50 of the body 42 lies in the same generally horizontal plane as the top face 32 of the footing 10.

After the channel 34 is secured to the footing 10, the corrugated track 36 and guide 38 are installed. In some embodiments of the present invention, the track 36 and guide 38 may be manufactured as separate components, whereas in alternative embodiments of the invention, the track 36 and guide 38 are either integral or coupled together prior to installation.

As described above, the track 36 is installed so as to horizontally extend at least partially, and preferably completely, across the channel 34. Thus, the ridges 70 and furrows 72 of the corrugated track 36 lie generally perpendicular to a length of the channel 34. The track 36 may be secured to the channel 34 and/or the basement footing 10, although such is not required. If the track 36 is secured to the channel 34, it may be secured via screws, bolts, or other suitable fasteners (not shown) at intermittent locations along the second flange 46 of the channel 34, or alternatively or in addition to, may be secured at intermittent locations along the first flange 44 of the channel 34.

The water guide 38 is positioned directly adjacent the interior face 22 of the basement wall 12, such that an exterior face of the projections 40 at least partially contacts the basement wall 12. When water trickles down the basement wall 12, the water will contact the upper end 92 of the projections 40 and be diverted by the projections 40 to the ridges 70, where the water will then be directed to the channel 34.

As can be appreciated, a plurality of respective channels 34, tracks 36, and water guides 38 are aligned about the interior perimeter of the building's foundation 26. Specially sized pieces may be used or cut to accommodate any curves or angles of the perimeter. For example, two channel pieces meeting each other at a corner of the perimeter may be formed and sized to accommodate the 90° angle, such as mitering two 45° end pieces.

Once the channel 34, track 36, and water guide 38 are installed, the basement floor slab 14 is poured over the track 36 and in direct contact with the water guide 38, as illustrated in FIGS. 1,2, and 4. Unlike prior art systems, a height of the poured floor slab 14 is the same as or very close to the same as the height without use of the water diverting system 24 of the present invention. In particular, in some prior art systems that install a pipe above the footing, the height of the floor slab poured over the pipe is then substantially less than the height of the floor slab at other locations. This variance in floor slab height tends to produce areas of weakness due to varying load paths, which result in cracks in the floor slab over time. Use of the present invention, however, allows for a consistent floor slab height along an entire area of the slab.

Once installed, the water diverting system 24 meets building code requirements for having the full height of the basement floor slab 14 contact the basement wall 12 and basement footing 10. This building requirement is implemented so that heavy point loads, such as due to use of heavy appliances against the basement wall 12, do not result in the above-described areas of weakness. Because the water guide 38 of the present invention directly contacts the basement wall 12, building code requirements are met. Moreover, the intermittently spaced projections 40 provide sufficient structural support so as to not be crushed against the basement wall 12 once the floor slab 14 is poured.

The water diverting system 24 of the present invention thus serves to collect water at three areas where water commonly enters a basement. Referring to FIG. 1, the first area comprises the water-saturated soil in the interior of the foundation, where the water is pushed upward into the opening formed by the downwardly extending ridge 70. The water is mingled with dirt. However, because water droplets are lighter than the dirt, the water will be pulled into the ridges 70 while the dirt will stay behind. The ridges 70 then serve to direct the water to the body 42 of the channel 34.

The second area for water collection occurs at the cove joint, where the bottom of the basement wall 12 intersects the footing 10. Water will often travel underneath the basement wall 12 and between the footing 10 to then sit at the cove joint. The present invention diverts the water through the bottom of the guide 38 in fluid communication with the ridges 70 and to the body 42 of the channel 34. Similarly, at the third area where water trickles down the basement wall 12, the projections 40 of the guide 38 direct water to the bottom 88 of the guide 38, to the ridges 70, and then to the body 42 of the channel 34. The channel 34 is then connected with one or more discharge pipes (not shown), which direct the water to an exterior of the building or to a sump pump basin (not shown). Thus, the system 24 of the present invention serves to protect the basement floor slab 14 at all points along the perimeter so that water does not have an opportunity to stagnate on the slab perimeter and weaken it. Applicant has found that the water diverting system 24 of the present invention has greater than twice the water diverting and carrying capacity of prior art systems.

Although the invention has been described with reference to the embodiments illustrated in the attached drawing figures, it is noted that equivalents may be employed and substitutions made herein without departing from the scope of the invention as recited in the claims. For example, embodiments of the present invention may employ only the channel, only the track, only the guide, or any combination thereof.

Having thus described various embodiments of the invention, what is claimed as new and desired to be protected by Letters Patent includes the following:

1. A system for diverting water from a building's foundation having a basement wall with an interior face oriented towards an interior of the foundation and a basement floor slab, said system comprising:

a channel for collecting water, said channel having lower and upper portions and a generally horizontally extending flange intersecting the upper portion of the channel and configured to be secured to a top face of a basement footing, wherein said lower portion is closed, such that water cannot enter through the lower portion, and wherein said upper portion has at least one opening formed therein for receipt of water through the at least one opening, said channel configured for installation below the basement floor slab and generally proximal to an interior face of the basement footing, wherein at least a portion of the channel contacts the basement wall, the top face of the basement footing, or the interior face of the basement footing;

a generally horizontally extending track positioned directly below and contacting the basement floor slab for guiding water horizontally along the track and to the channel, said track positioned above the at least one opening in the upper portion of the channel and contacting the channel, such that water draining generally horizontally along the track is guided directly to the at least one opening in the upper portion of the channel and is collected within the channel through only the at least one opening without intermixing with sediment from the interior of the foundation, wherein said flange intersecting the upper portion of the channel provides for a continuous water pathway, for the water draining horizontally along the track, from the basement wall or the top face of the basement footing and to the at least one opening in the upper portion of the channel.

2. The system of claim 1, wherein the track is configured to directly contact the channel to direct water into the channel.

3. The system of claim 1, wherein when the channel is proximal the basement footing, an uppermost end of the top end of the channel lies in the same generally horizontal plane as the top face of the basement footing.

4. The system of claim 1, said track having a first end and a second end and presenting a plurality of downwardly extending ridges extending horizontally between the first and second ends, such that each ridge is spaced a vertical distance above the upper portion of the channel, said track further including a plurality of upwardly extending furrows, wherein the furrows are interposed with the ridges so as to create a generally corrugated track.

5. The system of claim 1, wherein the generally horizontally extending flange is integral with the upper portion of the channel.

6. A system for diverting water from a building's foundation having a basement wall with an interior face oriented towards an interior of the foundation and a basement floor slab, said system comprising:

a channel for collecting water, said channel having a body presenting a closed bottom end and a top end, said body having an opening at the top end for receipt of water into the body, said body configured for installation below the basement floor slab and generally proximal to the basement wall or an interior face of a basement footing, wherein at least a portion of the channel contacts the basement wall, a top face of the basement footing, or the interior face of the basement footing; and a generally horizontally extending track having a first end and a second end and presenting a plurality of downwardly extending ridges extending horizontally between the first and second ends, said track positioned directly below and contacting the basement floor slab, at least a portion of said track positioned directly over the opening in the top end of the body of the channel and contacting the channel, such that each ridge is spaced a vertical distance above the top end of the body of the channel, wherein water draining generally horizontally through the downwardly extending ridges is guided directly to the opening at the top end of the body of the channel and is collected within the channel through only the top end of the channel without intermixing with sediment from the interior of the foundation.

7. The system of claim 6, wherein the channel further includes a flange extending generally horizontally from the top end of the body of the channel, wherein the flange is configured to be secured to the top of the basement footing.

8. The system of claim 7, wherein the at least a portion of the channel that contacts the top of the basement footing is the flange extending generally horizontally from the top end of the body of the channel.

9. The system of claim 6, wherein said channel is secured to either of the basement wall or the basement footing.

10. The system of claim 6, wherein when the channel is proximal the basement footing, an uppermost end of the top end of the channel lies in the same generally horizontal plane as the top face of the basement footing.

11. The system of claim 6, wherein the track is corrugated, such that in addition to the plurality of downwardly extending ridges, the track further presents a plurality of upwardly-extending furrows.

12. The system of claim 11, further including a generally vertically extending guide configured for installation proximate to the interior face of the basement wall for diverting water entering along the interior face of the basement wall to the channel, said guide presenting a wall generally perpendicular to the track, said wall having a plurality of intermittently spaced projections extending towards the interior face of the basement wall, wherein each projection of the guide presents a generally non-flat upper end for diverting water contacting the upper end towards the ridges of the track.

13. The system of claim 12, wherein the upper end of each projection has first and second angled upper sides so as to present an inverted V-shape.

14. The system of claim 12, wherein the upper end of the projection is generally arcuate.

* * * * *